US006341801B1

(12) United States Patent
Johnson et al.

(10) Patent No.: US 6,341,801 B1
(45) **Date of Patent: *Jan. 29, 2002**

(54) GENERATING TEXT IN WHICH THE WORD SEQUENCE IS REVERSED IN ALTERNATING LINES OF TEXT

(75) Inventors: Gary R. Johnson, 1302 E. Jefferson, P.O. Box 824, Boise, ID (US) 83701; Kenneth J. Wolfe, Boise, ID (US)

(73) Assignee: Gary R. Johnson, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/650,243

(22) Filed: Aug. 29, 2000

Related U.S. Application Data

(63) Continuation-in-part of application No. 08/935,005, filed on Sep. 22, 1997, now Pat. No. 6,113,147.

(51) Int. Cl.[7] ..... B42D 15/00
(52) U.S. Cl. ..... 283/62; 283/45; 434/167
(58) Field of Search ..... 283/45, 46, 62; 434/156, 178, 179, 167

(56) References Cited

U.S. PATENT DOCUMENTS 1,122,110 A * 4/1914 Hansen
4,078,319 A * 3/1978 Mazeski et al. ..... 35/35 R
5,033,964 A * 7/1991 Phelps ..... 434/113
5,182,709 A 1/1993 Makus ..... 364/419
5,474,456 A * 12/1995 Paiken ..... 434/178
5,579,224 A 11/1996 Hirakawa et al. ..... 395/752
5,649,234 A * 7/1997 Klappert et al. ..... 395/806
5,651,678 A * 7/1997 Phillips ..... 434/170
6,113,147 A * 9/2000 Johnson ..... 283/62

FOREIGN PATENT DOCUMENTS

CN 1045731 A 10/1990

OTHER PUBLICATIONS

Sawaie, Mohammed, Arabic Phonology & Script: An Introduction, pp. 19 and 29, Jun. 1986.*

* cited by examiner

*Primary Examiner*—A. L. Wellington
*Assistant Examiner*—Monica Carter
(74) *Attorney, Agent, or Firm*—Ormiston & McKinney, PLLC

(57) ABSTRACT

Methods and computer software for generating Glidetext™—that is, text in which the word sequence in a first line of text is from left to right followed by a second line of text in which the word sequence is from right to left and continuing in this alternating fashion throughout a piece of text. The method comprises converting text in which the word sequence is the same in every line to text in which the word sequence in every other line is from right to left. Only the word sequence is reversed, the sequence and orientation of the letters in each word in all lines stays the same.

15 Claims, 7 Drawing Sheets

GENERATING TEXT IN WHICH THE WORD SEQUENCE IS REVERSED IN ALTERNATING LINES OF TEXT

CROSS REFERENCE TO RELATED APPLICATION

This is a continuation in part of application Ser. No. 08/935,005 filed Sep. 22, 1997 now U.S. Pat. No. 6,113,147, incorporated herein by reference in its entirety.

FIELD OF THE INVENTION

The invention relates to the conversion of conventional text in which every line of text is read from left to right to a new form of text in which every other line of text is read from right to left.

BACKGROUND

Conventional text is normally read one line at a time from left to right. At the end of each line the reader disconnects the brain and eyes, returns the brain and eyes to the beginning of the next line, and reconnects with the first word on that line. The extra weight on the brain and eyes caused by one disconnect/reconnect per line of reading slows and strains the reader. A new type of text has been invented to overcome some of the difficulties reading conventional text. In this new text, which is described in U.S. patent application Ser. No. 08/935,005, the word sequence in every other line of text is reversed so the reader when finished reading one line from left to right drops her eyes directly below to begin reading the next line from right to left. The following paragraph is an example of this new text.

The new text eliminates the brain and eyes disconnect/reconnect interruption. It text structured traditionally of line each of end the at reader the by experienced does so by reversing the sequence of words on every other line of text thereby to appears format reading new different. This flow reading continuous a permitting be quickly grasped by beginning or capable readers of any age.

This new text is sometimes referred to herein for convenience as Glidetext™.

SUMMARY

The present invention is directed to methods and computer software for generating Glidetext™—that is, text in which the word sequence in a first line of text is from left to right followed by a second line of text in which the word sequence is from right to left and continuing in this alternating fashion throughout the text. The relevant "text" includes any of the various parts of an electronic or printed document. Each paragraph, page or other natural break in the words of a document may define the relevant text. If the relevant text is a paragraph, for example, the alternating word sequence begins anew with each paragraph so that the word sequence in the first line of each paragraph is from left to right.

In one embodiment of the invention, the method comprises converting text in which the word sequence is the same in every line to text in which the word sequence in every other line is from right to left.

In one embodiment, the method comprises converting text in which the word sequence in every line is from left to right to text in which the word sequence in every other line is from right to left. This conversion may be accomplished by reversing the word sequence in every other line of text.

The foregoing summary is not intended to be an inclusive list of all aspects and features of the invention nor should any limitation on the scope of the invention be implied from this summary. The summary is provided in accordance with the requirements of 37 C.F.R. § 1.73 and the Manual of Patent Examining Procedure (MPEP) 608.01 (d) merely to apprise the public of the nature of the invention.

DETAILED DESCRIPTION

"Computer software" or "software" as those terms are used in the Summary, Description and Claims mean any computer readable instructions in any form that when executed cause a computer to perform a desired act, task or operation. Software, therefore, includes but is not limited to computer readable instructions residing on or executable from a CD (compact disc), diskette, hard drive, RAM (random access memory), ROM (read only memory), firmware or ASIC (application specific integrated circuit).

In the following description, reference is made to the accompanying drawings that illustrate specific embodiments of the invention. It is to be understood that other embodiments may be utilized and structural or logical changes may be made without departing from the spirit and scope of the invention. The following description and the drawings, therefore, are not to be taken in a limiting sense. The scope of the invention is defined in the appended Claims.

Figure 1:
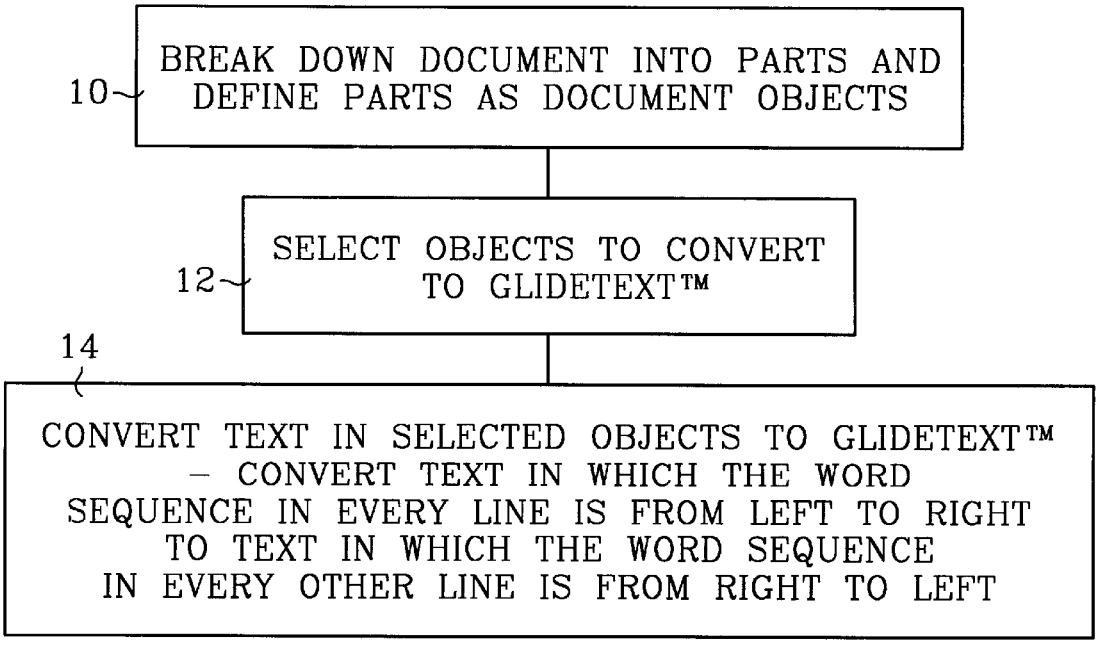
FIG. 1 is a flow chart illustrating one method for converting a conventional text document to a Glidetext™ document.

Referring to FIG. 1, the process of converting a conventional text document to a Glidetext™ document and the software implementing that process will typically begin by breaking the document down into basic parts and defining those parts electronically as separate computer objects (step 10). The objects are to be used to identify and distinguish between parts of the document that will and will not be converted to Glidetext™. In a book, for example, the title page, table of contents and chapter headings (which will not be converted) and the text in each chapter or each paragraph within this text (which will be converted) would be defined as separate objects. As will be apparent to those skilled in the art of object oriented computer programming, a document could be broken down into many different objects. Headings, paragraphs, sentences or even words, page numbers and characters could be defined as separate objects. It is expected that for most conversions of conventional text documents to Glidetext™ documents, only the textual parts of the document will be converted to Glidetext™. Headings, tables and other short pieces of text usually will not be converted. Hence, the primary textual objects in most documents will not be smaller than a paragraph.

Software embodying the invention initially will likely be designed for use with conventional word processing software such as Microsoft Word™ or Corel Wordperfect™. It is envisioned that as Glidetext™ becomes a commercially viable alternative to conventional text, software embodying the invention will be incorporated into and become an integral part of word processing software packages. The basic parts of documents created with some conventional word processing or publishing software packages may already be broken down into objects such as those noted above. It may be possible for many such documents to use the predefined objects. Hence, defining objects in step 10 for converting a document may not be necessary separate and apart from the creation of the document itself.

Once the objects are defined, the publisher, editor or other user goes through the document and identifies or selects the objects that will be converted to Glidetext™ (step 12). The conversion objects may be selected manually or automatically through the use of predefined user preferences. Then, the text in the selected objects is converted to Glidetext™ (step 14). That is to say, for the selected objects, the conventional text in which the word sequence in every line is from left to right is converted to text in which the word sequence in every other line is from right to left.

Figure 2A:
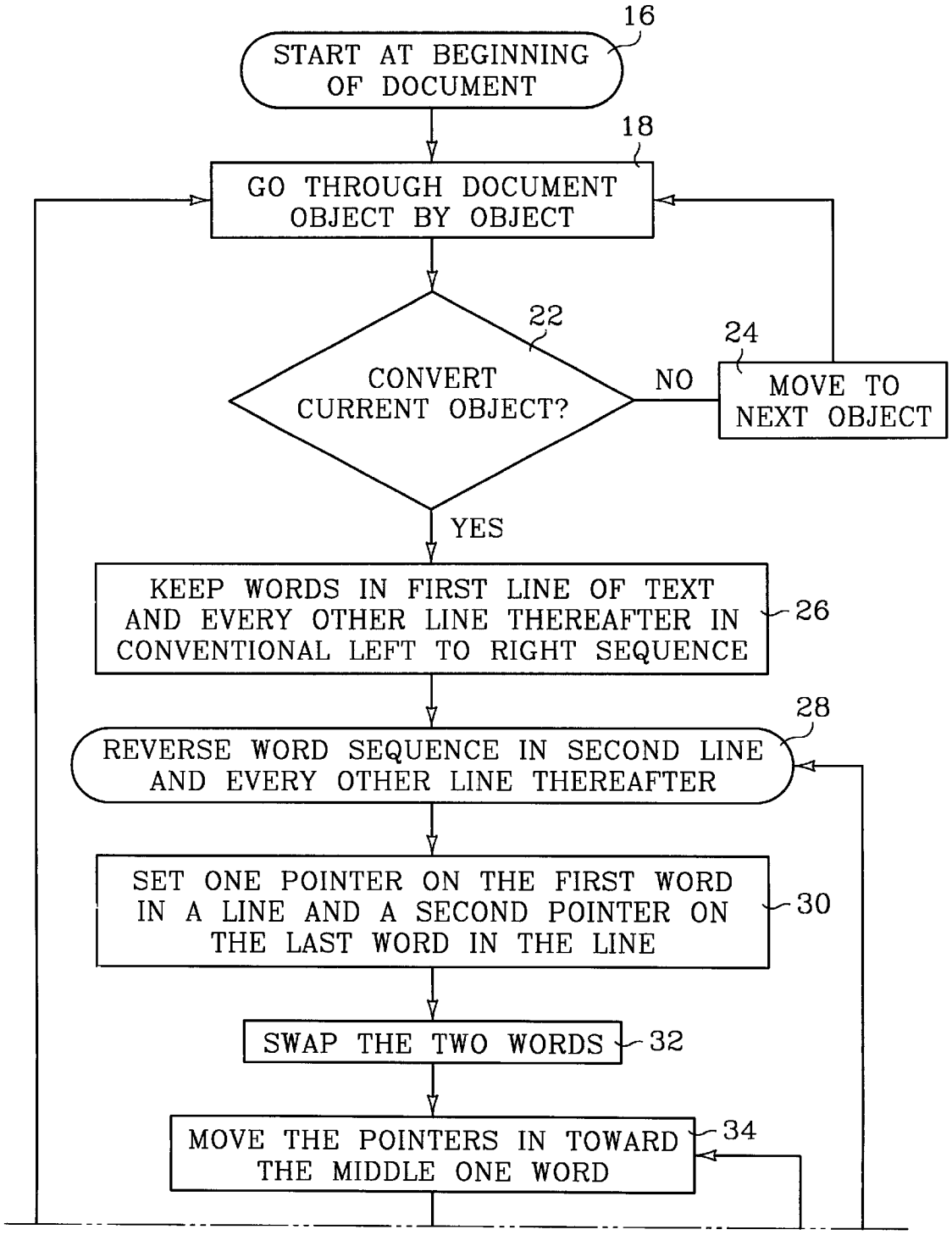
FIGS. 2A and 2B are a flow chart illustrating one method for converting conventional text to Glidetext™.
Figure 2B:
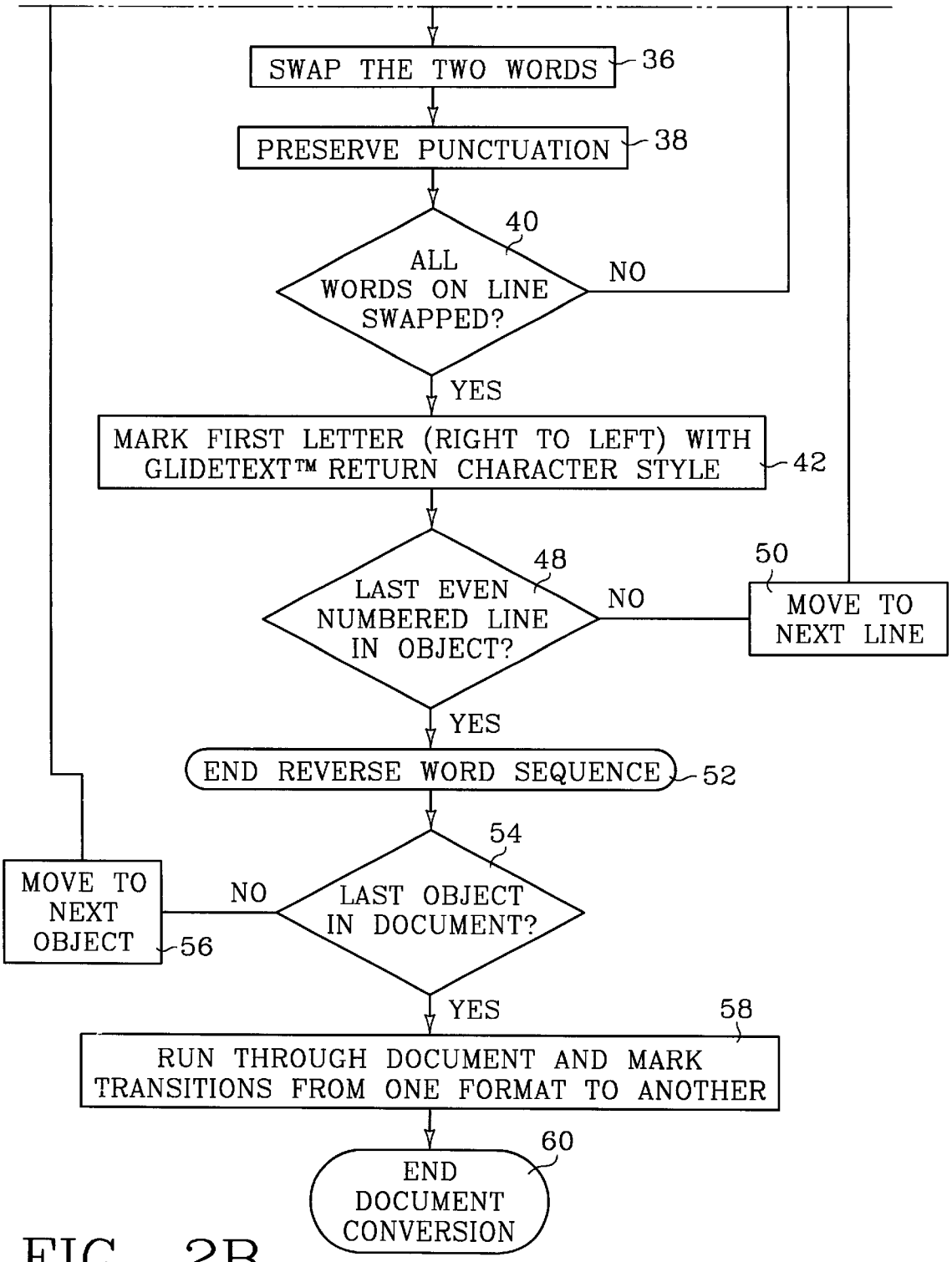

One embodiment for converting a conventional text document to a Glidetext™ document is shown in more detail in FIGS. 2A and 2B. Referring to FIGS. 2A and 2B, starting at the beginning of the document, evaluate each object to determine if it is to be converted to Glidetext™ (steps 16–22). For objects that will not be converted, move to the next object (step 24). For objects that will be converted, keep words in the first line of text and in every other line thereafter (i.e., the odd numbered lines of text) in conventional left to right sequence (step 26). Then, reverse the word sequence in the second line of text and in every other line thereafter (i.e., the even numbered lines of text) (step 28). Only the word sequence is reversed—the sequence and orientation of the letters in each word in all lines stays the same.

In the embodiment of the invention shown in FIGS. 2A and 2B, reversing the word sequence is accomplished through steps 30–52 as follows. For the each even numbered line, set one pointer on the first word in the line and a second pointer on the last word in the line (step 30). Then, swap the two words so that the first word on the line becomes the last word and the last word becomes the first word (step 32). Reset the pointers in one word towards the middle of the line, swap those words and repeat this process until all words on the line have been swapped (steps 34–40).

Punctuation is preserved in step 38 by associating the punctuation and its spacing with the immediately preceding word in the text but swapping the punctuation to the other side of the word. So, punctuation appears on the left side of the word in Glidetext™ rather than on the right side of the word as in conventional text.

It may be desirable in some texts to mark the first letter of each right to left line (step 42) to minimize any confusion for the reader as to the direction of the word sequence in that line. This may be accomplished, for example, with underline, bold print, italics or an oversize letter.

If the line is not that last even numbered line in the object, move to the next line and repeat steps 30–42 (steps 48 and 50). If the line is the last even numbered line in the object, end the reverse word sequence sub-routine (step 52) and proceed to the next object (steps 54 and 56). Once the last object has been completed, it may be desirable in some documents to mark transitions from one text format to another (step 58). This may be accomplished, for example, by placing a watermark or other symbol at the beginning of Glidetext™ formatted text and at the beginning of conventionally formatted text. Preferably, the symbols will be different to allow the reader to more readily determine the format of the text noted by the symbol. Alternatively, each object may be marked as it is converted to signify the transition from conventional text to Glidetext™ and from Glidetext™ to conventional text.

Figure 3A:
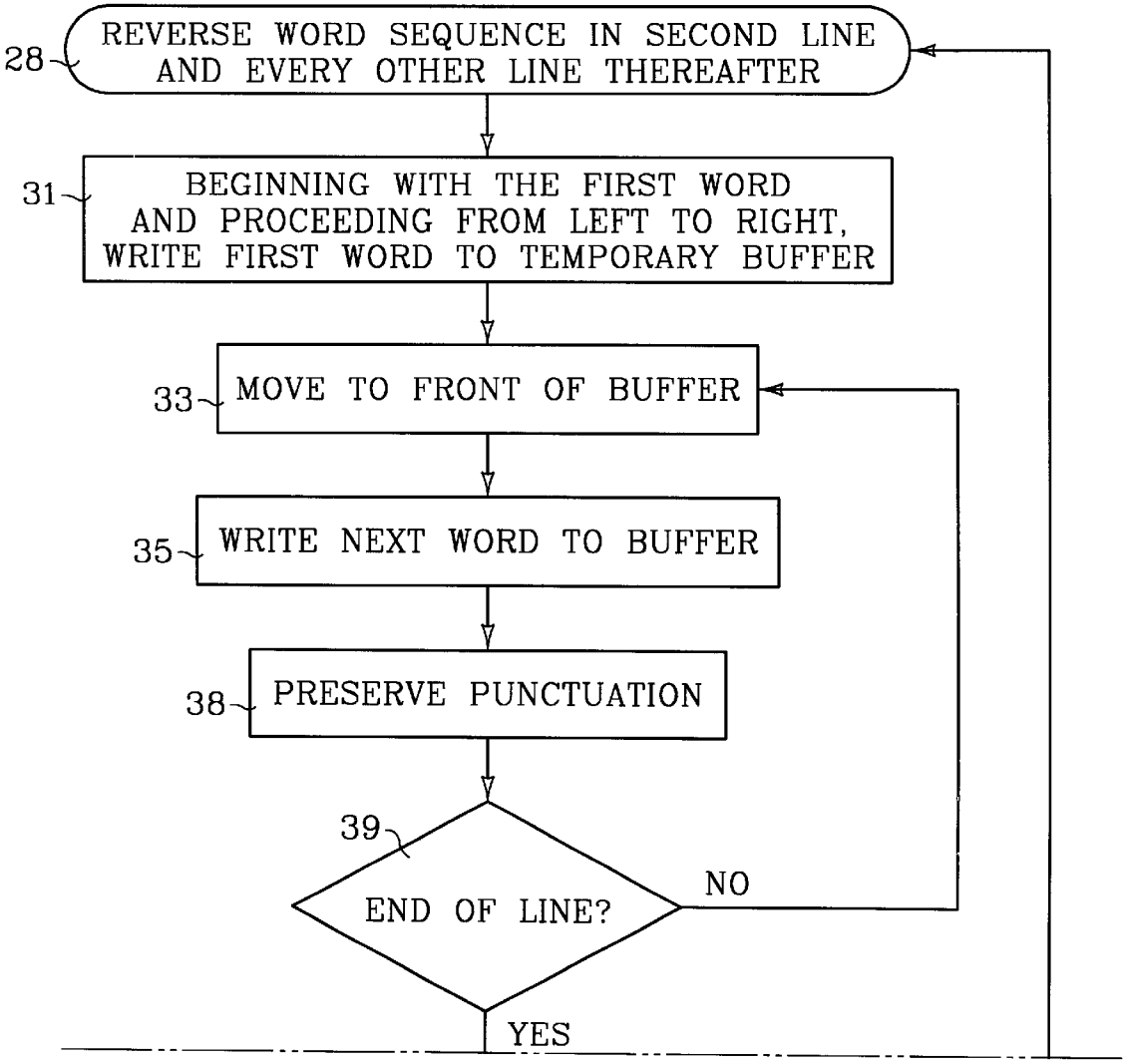
FIGS. 3A and 3B are a flow chart illustrating one method for reversing the word sequence in even numbered lines of text.
Figure 3B:
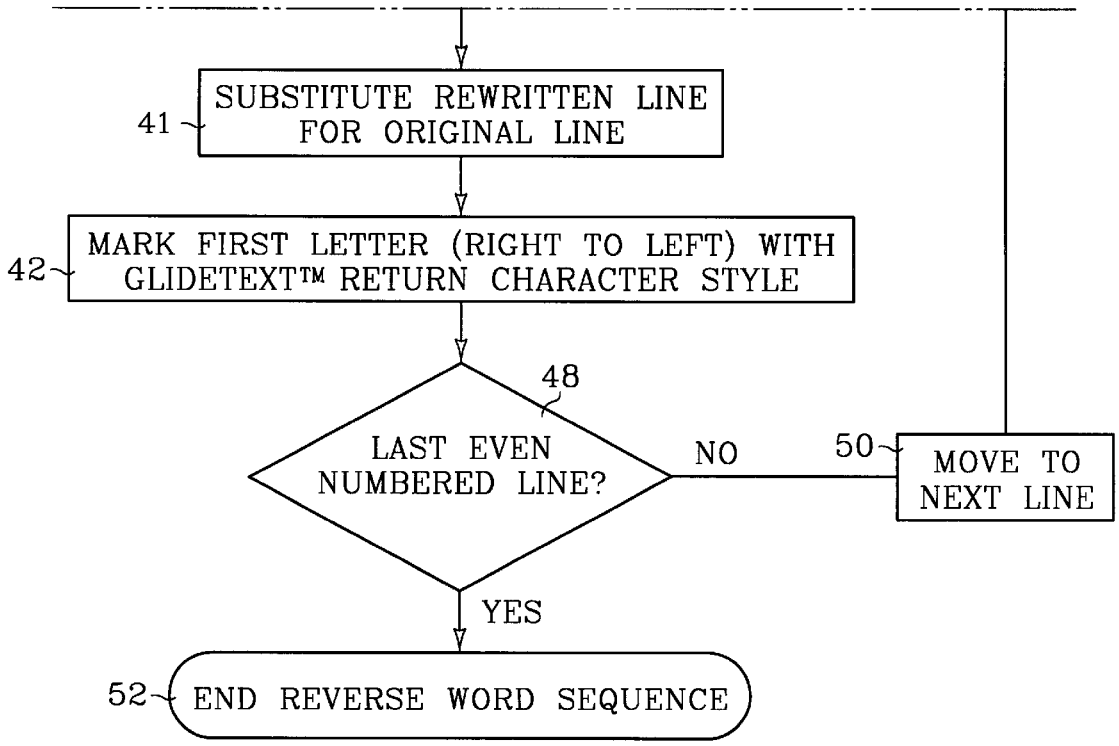

An alternative embodiment for reversing the word sequence is illustrated in the flow chart of FIGS. 3A and 3B. The embodiment shown in FIGS. 3A and 3B rewrites each even numbered line in a second document, temporary buffer or other work area and then replaces the original line with the rewritten line. Referring to FIGS. 3A and 3B, beginning with the first word in the line and proceeding from left to right, write the first word to a temporary buffer (step 31), move to the front of the buffer (step 33), write the next word to the buffer (step 35), preserve the punctuation and continue until each word in the line has been written to the buffer (steps 31–39).

The application of steps 31–39 is illustrated below for the following line of text.

This is an even numbered line of text.

| Temporary Buffer | |
|---|---|
| Step 31 | This |
| Steps 33 and 35 | is This |
| Repeat Steps 33 and 35 | an is This |
| Repeat Steps 33 and 35 | even an is This |
| Repeat Steps 33 and 35 | numbered even an is This |
| Repeat Steps 33 and 35 | line numbered even an is This |
| Repeat Steps 33 and 35 | of line numbered even an is This |
| Repeat Steps 33 and 35 | text of line numbered even an is This |
| Steps 33, 35 and 38 | .text of line numbered even an is This |

In the above illustration, the punctuation and associated spaces are treated as a separate word that is transferred after the adjacent word ("text" in this example). Alternatively, punctuation and associated spaces may be treated as part of the adjacent word and transferred along with the word. Treatment of punctuation will typically vary depending on how punctuation is treated in the base word processing software. In Microsoft Word™, for example, punctuation is treated as an object or "word" distinct from the adjacent word.

Once the line has been rewritten in reverse word sequence, the rewritten line is substituted for the original line by, for example, pasting the new line on to the document using cutting and pasting techniques available in conventional word processing software (step 39).

The processes described above can also be used to convert a Glidetext™ document to a conventional text document. For example, performing steps 16–60 in FIGS. 2A and 2B on a Glidetext™ document will yield a conventional text document. The steps are the same except that first letters and transitions are unmarked steps 42 and 58.

Figure 4:
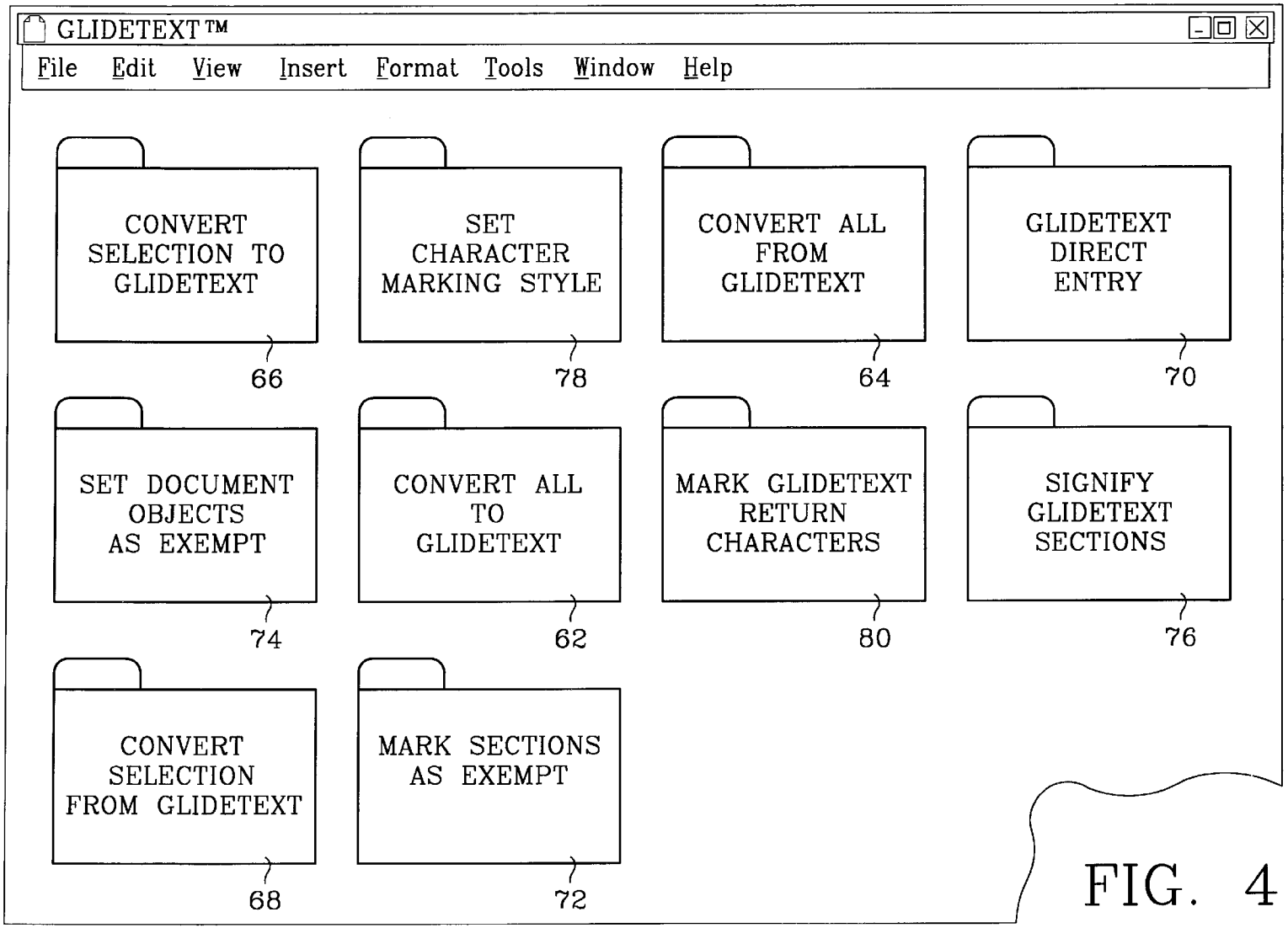
FIG. 4 is a graphical display illustrating a group of Glidetext™ menu selection icons such as might be displayed through a Windows™ operating system.

FIG. 4 illustrates a group of Glidetext™ menu selection icons such as might be displayed through a Windows™ operating system. The Convert All To Glidetext™ icon 62 is selected to convert a conventional text document to a Glidetext™ document using the process described above for FIGS. 2A and 2B. The Convert All From Glidetext™ icon 64 is selected to convert a Glidetext™ document back to a conventional text document using the process described above for FIGS. 2A and 2B.

Figure 5:
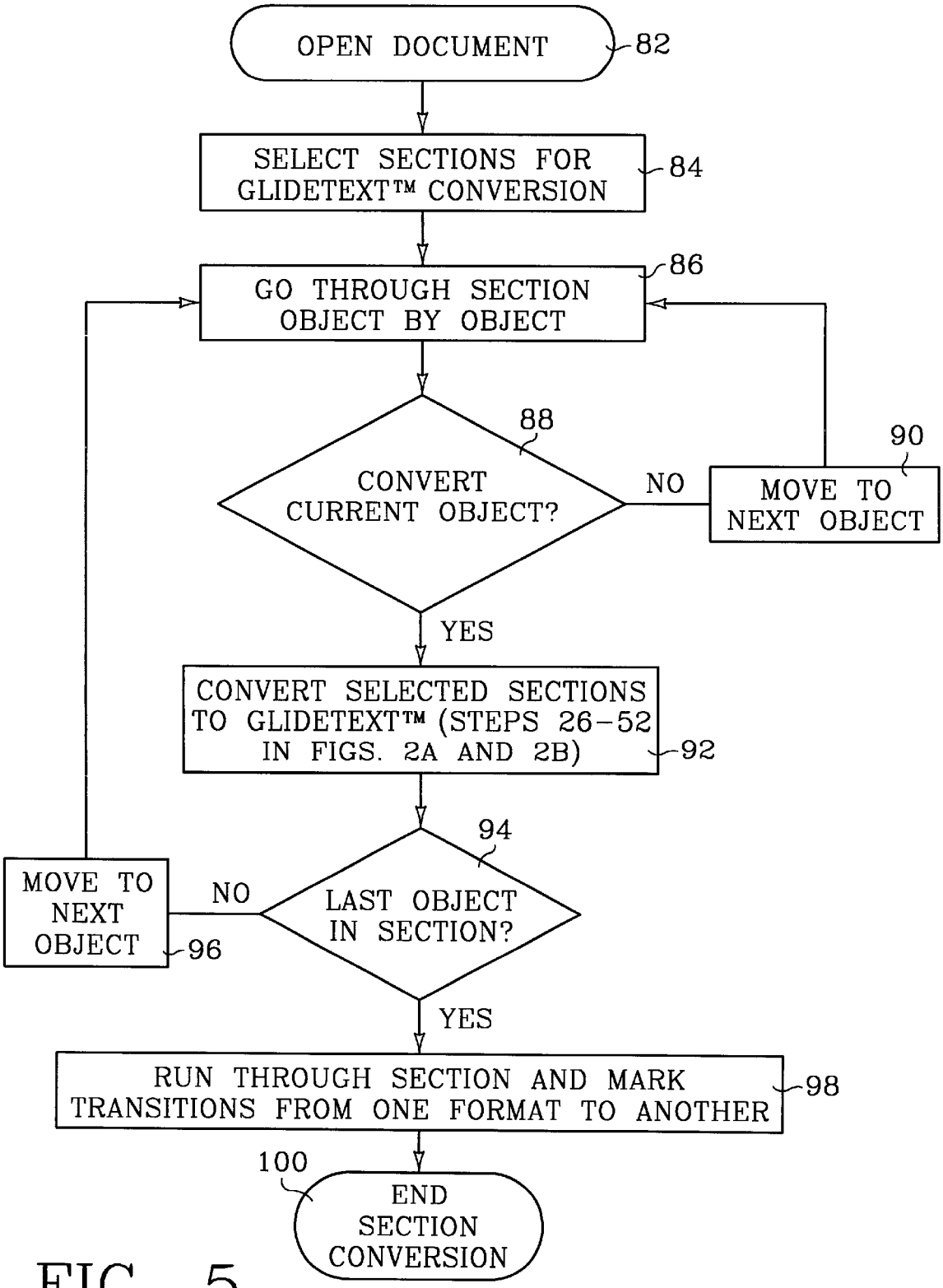
FIG. 5 is a flow chart illustrating one method for converting select portions of a conventional text document to Glidetext™.

The Convert Selection To Glidetext™ icon is selected to convert only selected portions of a document to Glidetext™ as shown in FIG. 5. Referring to FIG. 5, open the document and select the section or sections for conversion to Glidetext™ (steps 82 and 84). Starting at the beginning a section, evaluate each object in the section to determine if it is to be converted to Glidetext™ (steps 86 and 88). For objects that will not be converted, move to the next object (step 90). For each object to be converted, apply steps 26–52 in FIGS. 2A and 2B (steps 92–96). If all selected objects have been converted, mark the transitions from one text format to another (step 98) and end the section conversion (step 100).

The Convert Selection From Glidetext™ icon is selected to convert only selected portions of a document from Glidetext™ to conventional text using the process of FIG. 4 as applied to sections of a document that include Glidetext™.

Figure 6:
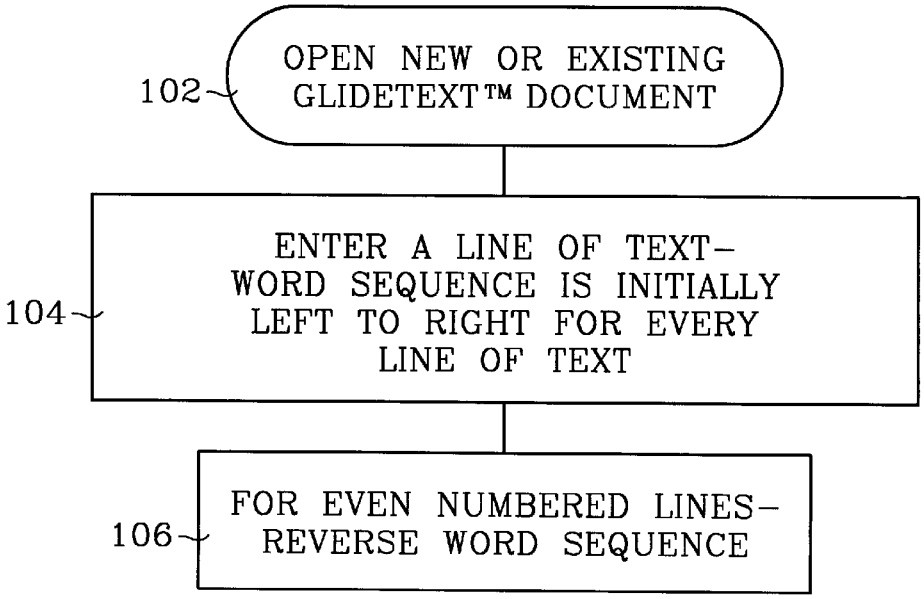
FIG. 6 is a flow chart illustrating one method for creating a document in Glidetext™ using conventional word processing techniques that create conventional text and the conversion techniques illustrated in FIGS. 2A and 2B.

One method for creating a document in Glidetext™ is illustrated in FIG. 6. This method for the direct entry of Glidetext™ uses conventional word processing techniques that create conventional text and the conversion techniques described above to generate the Glidetext™ document. Generating a Glidetext™ document may be initiated, for example, by selecting the Glidetext™ Direct Entry icon shown in the windows display of FIG. 4. Referring to FIG. 6, the word sequence in each line of text typed or otherwise entered by the user is initially formulated left to right (step 104). Then, after each even numbered line is entered, the word sequence in that line is reversed by, for example, the process of steps 30–42 in FIGS. 2A and 2B (step 106).

Referring again to FIG. 4, other features of the invention might also be displayed to the user as selectable icons. For example, user preferences for exempting certain sections of a document from conversion to Glidetext™ can be entered by selecting icon 72. Document objects can be exempted from conversion by selecting icon 74. Those sections of a document the user wishes to identify as sections containing Glidetext™ can be marked by selecting icon 76. Character marking style and Glidetext™ return characters can be set by selecting icons 78 and 80.

What is claimed is:

1. A method for converting text in which a word sequence in every line is from left to right to new text in which the word sequence in every other line is from right to left, the method comprising:

for every other line of the text, swapping a first word and a last word, moving toward a middle of the line of text by one word and swapping those two words, and repeating moving and swapping until all such word pairs on the line have been swapped.

2. A method for converting text in which a word sequence in every line is from left to right to new text in which the word sequence in every other line is from right to left, the method comprising:

for every other line of the text, rewriting the line with the sequence of words reversed; and substituting the rewritten line for the line.

3. The method according to claim 2, wherein the text is electronic text and rewriting comprises:

providing a temporary work area having a front;

beginning with a first word and proceeding from left to right, writing the first word to the temporary work area;

moving to the front of the temporary work area;

writing a next word to the temporary work area; and repeating moving and writing until all words in the line have been written to the temporary work area.

4. A method for selectively converting parts of a document in which a word sequence in every line of text is from left to right to text in which the word sequence in every other line is from right to left, the method comprising:

defining different parts of the document containing text as objects;

selecting objects containing text to convert;

for each of the selected objects keeping the words In a first line of text and every other line thereafter in left to right sequence, and reversing the word sequence in all other lines of the text by swapping a first word and a last word, moving toward a middle of the line of text by one word and swapping those two words, and repeating the acts of moving and swapping until all such word pairs on the line have been swapped.

5. A method for generating text in which a word sequence in a first line of text is from left to right followed by a second line of text in which the word sequence is from right to left and continuing in this alternating fashion throughout the text, the method comprising:

generating a first line of text in which the word sequence is from left to right;

generating a second line of text in which the word sequence is from left to right;

reversing the word sequence in the second line of text;

repeating generating a first line of text, generating a second line of text and reversing the word sequence in the second line of text until all lines of text are generated; and wherein the word sequence in even numbered lines of text is reversed before a next odd numbered line of text is generated.

6. A method for generating text in which a word sequence in a first line of text is from left to right followed by a second line of text in which the word sequence is from right to left and continuing in this alternating fashion throughout the text, the method comprising:

generating a first line of text in which the word sequence is from left to right;

generating a second line of text in which the word sequence is from left to right;

reversing the word sequence in the second line of text;

repeating generating a first line of text, generating a second line of text and reversing the word sequence in the second line of text until all lines of text are generated; and wherein the word sequence in even numbered lines is reversed after all lines of text have been generated.

7. A method for generating text having a word sequence, the text having a first line in which the word sequence is from left to right followed by a second line in which the word sequence is from right to left and continuing in this alternating fashion throughout the text, the method comprising:

converting text in which the word sequence is the same in every line to text in which the word sequence in every other line is from right to left; and arranging all letters in each word from left to right in all lines of text.

8. The method according to claim 7, wherein all letters in each word of the text in which the word sequence is the same in every line are arranged from left to right and arranging comprises maintaining the arrangement of the letters in each word from left to right in all lines of text.

9. A method for generating text having a word sequence, the text having a first line in which the word sequence is from left to right followed by a second line of text in which the word sequence is from right to left and continuing in this alternating fashion throughout the text, the method comprising:

converting text in which the word sequence in every line is from left to right to text in which the word sequence in every other line is from right to left; and arranging all letters in each word from left to right in all lines of text.

10. The method according to claim 9, wherein all letters in each word of the text in which the word sequence in every line is from left to right are arranged from left to right and arranging comprises maintaining the arrangement of the letters in each word from left to right in all lines of text.

11. The method according to claim 10, wherein converting comprises reversing the word sequence in every other line of text.

12. A method for generating text, comprising:

generating a first line of text having a word sequence from left to right;

generating a second line of text having a word sequence from left to right;

reversing the word sequence in the second line of text; and arranging all letters in each word from left to right in all lines of text.

13. The method of claim 12, further comprising repeating generating a first line of text, generating a second line of text and reversing the word sequence in the second line of text until all lines of text are generated.

14. The method of claim 13, wherein the word sequence in even numbered lines of text is reversed before a next odd numbered line of text is generated.

15. The method of claim 12, wherein the word sequence in even numbered lines is reversed after all lines of text have been generated.

* * * * *

UNITED STATES PATENT AND TRADEMARK OFFICE

CERTIFICATE OF CORRECTION

PATENT NO. : 6,341,801 B1 
DATED : January 29, 2002
INVENTOR(S) : Gary R. Johnson It is certified that error appears in the above-identified patent and that said Letters Patent is hereby corrected as shown below:

Column 1,
Lines 33-38, should read as follows:
-- The new text eliminates the brain and eyes disconnect/reconnect interruption. It text structured traditionally of line each of end the at reader the by experienced does so by reversing the sequence of words on every other line of text thereby to appears format reading new different. This flow reading continuous a permitting be quickly grasped by beginning or capable readers of any age.

Column 6,
Line 14, delete "In" and insert -- in --

Signed and Sealed this

Eighteenth Day of March, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,341,801 B1
DATED : January 29, 2002
INVENTOR(S) : Gary R. Johnson It is certified that error appears in the above-identified patent and that said Letters Patent is hereby corrected as shown below:

Column 1,
Lines 33-38, should read as follows:
-- The new text eliminates the brain and eyes disconnect/reconnect interruption
It .text structured traditionally of line each of end the at reader the by experienced
does so by reversing the sequence of words on every other line of text thereby
to appears format reading new different This .flow reading continuous a permitting
be quickly grasped by beginning or capable readers of any age.

Column 6,
Line 14, delete "In" and insert -- in --

This certificate supersedes Certificate of Correction issued March 18, 2003.

Signed and Sealed this

Fifteenth Day of July, 2003

JAMES E. ROGAN
*Director of the United States Patent and Trademark Office*